US007923942B1

(12) United States Patent
Xiong et al.

(10) Patent No.: US 7,923,942 B1
(45) Date of Patent: Apr. 12, 2011

(54) CONSTANT CURRENT SOURCE MIRROR TANK DIMMABLE BALLAST FOR HIGH IMPEDANCE LAMPS

(75) Inventors: Wei Xiong, Madison, AL (US); Thomas Lunn, Hazel Green, AL (US); Christopher Radzinski, Huntsville, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 252 days.

(21) Appl. No.: 12/100,288

(22) Filed: Apr. 9, 2008

Related U.S. Application Data

(60) Provisional application No. 60/988,926, filed on Nov. 19, 2007.

(51) Int. Cl.
*H05B 37/02* (2006.01)

(52) U.S. Cl. ..... 315/308; 315/210; 315/224; 315/226; 315/244; 315/289; 315/309; 315/DIG. 4

(58) Field of Classification Search ..... 315/210, 315/224, 225, 226, 227 R, 228, 244, 246, 315/283, 289, 291, 307, 308, 309, DIG. 4
See application file for complete search history.

(56) References Cited

U.S. PATENT DOCUMENTS

| | | | | |
|---|---|---|---|---|
| 4,060,751 | A | 11/1977 | Anderson | |
| 4,585,974 | A | 4/1986 | Stupp et al. | |
| 4,873,471 | A | 10/1989 | Dean et al. | |
| 5,294,868 | A * | 3/1994 | Jones et al. | 315/205 |
| 5,475,284 | A | 12/1995 | Lester et al. | |
| 5,977,725 | A | 11/1999 | Miyazaki et al. | |
| 6,236,168 | B1 * | 5/2001 | Moisin | 315/291 |
| 6,741,043 | B2 | 5/2004 | Prasad | |
| 7,187,132 | B2 * | 3/2007 | Bakre | 315/94 |
| 7,528,558 | B2 * | 5/2009 | Yu et al. | 315/308 |

* cited by examiner

*Primary Examiner* — Thuy Vinh Tran

(74) *Attorney, Agent, or Firm* — Waddey & Patterson; Mark J. Patterson

(57) ABSTRACT

A constant current source mirror tank dimmable ballast operates multiple high impedance lamps in a stable and balanced manner. The dimmable ballast has an inverter connected to two third-order resonant circuits. These third-order resonant circuits dominate the transfer function of the ballast circuits. Consequently, changes in the impedance of the lamp do not affect the current output to the lamps.

12 Claims, 1 Drawing Sheet

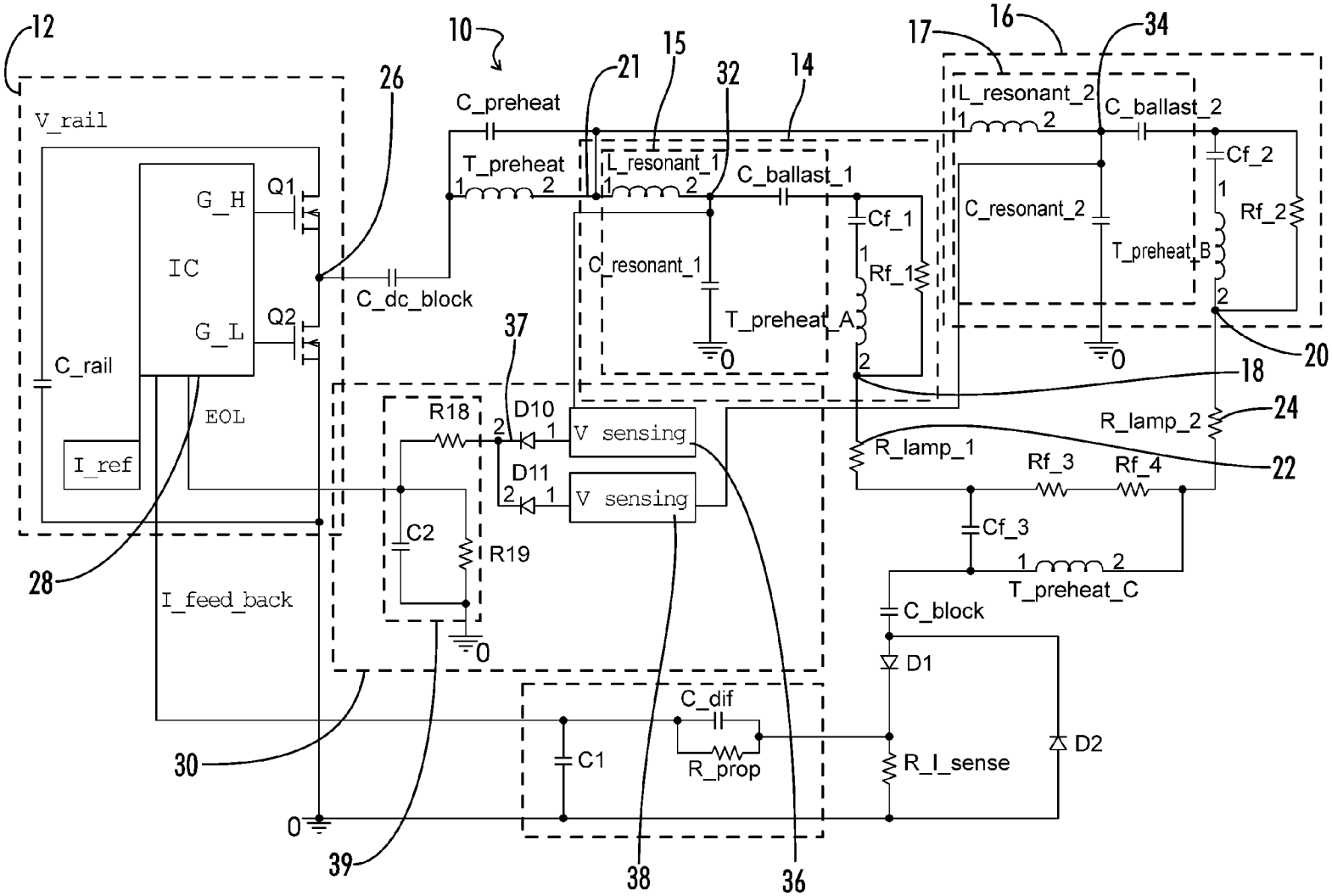
C_ballast_2
Cf_2
Rf_2
T_preheat_B
C_resonant_2
L_resonant_2
R_lamp_2
Rf_4
Rf_3
Cf_3
T_preheat_C
D2
D1
C_block
R_I_sense
R_lamp_1
Cf_1
Rf_1
T_preheat_A
C_ballast_1
C_resonant_1
L_resonant_1
C_preheat
T_preheat
C_dc_block
V sensing
V sensing
D10
D11
R18
R19
C2
C_dif
R_prop
C1
Q1
Q2
G_H
G_L
IC
EOL
I_feed_back
I_ref
C_rail
V_rail
0
10
12
14
15
16
17
18
20
21
22
24
26
28
30
32
34
36
37
38
39

CONSTANT CURRENT SOURCE MIRROR TANK DIMMABLE BALLAST FOR HIGH IMPEDANCE LAMPS

CROSS-REFERENCES TO RELATED APPLICATIONS

This application is a non-provisional application which claims benefit of U.S. patent application Ser. No. 60/988,926 filed Nov. 19, 2007, entitled "A CONSTANT CURRENT SOURCE MIRROR TANK DIMMABLE BALLAST FOR HIGH IMPEDANCE LAMP" which is hereby incorporated by reference.

BACKGROUND OF THE INVENTION

The present invention relates generally to electronic ballasts for gas discharge lamps. More particularly, this invention pertains to a dimmable ballast that operates multiple high impedance lamps in a stable and balanced manner.

Dimmable ballasts have gained popularity due to their ability to control the illumination level of gas discharge lamps. For example, dimmable ballasts may be designed to power lamps at both a dimming power level and a normal power level. This ability to control the power output to the lamp increases the energy efficiency of a facility utilizing gas-discharge lamps to light a space.

Facilities also save energy by utilizing energy efficient gas discharge lamps. However, prior art dimmable ballast have difficulty dimming multiple energy efficient gas discharge lamps due to the high impedance of these lamps when operated at dimming power levels. For example, some of these lamps experience very high impedance at dimming power levels, around 4 k at 50 mA. Consequently, the ballast is unable to control the current to the lamps due to the high leakage currents to ground. This results in lamp flicker and makes it difficult to start the lamp if ambient temperatures are low (below 20 C.°) or when the lamp leads are extended greater than 5 feet.

Also, multiple high impedance lamps may present an unbalanced load to the power source. For example, a 35 watt and 14 watt lamps may be connected simultaneously to an electronic ballast. It is desirable that both of these lamps receive substantially the same current from the power source during operation. In these situations, prior art lamp ballasts have been unable to balance the current between the lamp loads.

What is needed then is an inexpensive and reliable dimmable ballast that can control the current to multiple high-impedance gas discharge lamps.

BRIEF SUMMARY OF THE INVENTION

To control the current to at least two high-impedance gas discharge lamps, first and second ballast circuits are connected effectively in parallel to an inverter circuit. Each of these ballast circuits has a resonant circuit which is connectable to a high impedance lamp. Each resonant circuit is a third-order resonant circuit or higher. Consequently, the transfer function for each of these resonant circuits has at least three poles. In one embodiment, each third-order resonant circuit has a resonant inductor, a resonant capacitor, and a ballast capacitor which is connected in series with the resonant inductor and capacitor. By appropriately selecting the reactance of these components, the ballast provides stable and balanced operation to the high impedance lamps.

For example, in one embodiment of the invention, the reactance of the resonant inductor will be dominant in the transfer function equation of the ballast circuit. In contrast, the reactance of the resonant capacitor must be very small compared to the reactance of the ballast capacitor so that the resonant capacitor's reactance can be neglected in the transfer function. When the reactance of the resonant inductor combined with the reactance of the ballast capacitor is significantly greater than the impedance of a lamp, changes in the lamp impedance do not significantly change the current being delivered by the respective ballast circuit. This stabilizes and balances the current delivered to lamps.

In addition, an end of life protection circuit may be connected to each resonant circuit to receive an end of life signal. These end of life signals are received and transmitted to an end of life circuit in the inverter. This is needed because if the end of life signal is set for full power operation, the ballast would shutdown when the lamp was dimmed due to the dramatic rise in the voltage of the lamp when dimming. The end of life protection circuit is preferably connected to an input terminal on the resonant capacitor. Voltage sensing circuits receive end of life signals from both resonant circuits and diodes add the end of life signals. This permits an end of life circuit in the inverter circuit to function properly.

BRIEF DESCRIPTION OF THE SEVERAL VIEWS OF THE DRAWINGS

The Drawing is a circuit diagram of one embodiment of the invention.

DETAILED DESCRIPTION OF THE INVENTION

The basic topology of a preferred embodiment of the electronic ballast 10 in accordance with the invention is shown in the Drawing. An inverter 12 is coupled to first and second ballast circuits 14, 16. The inverter 12 and the ballast circuits 14, 16 convert a DC voltage, V_rail, into an AC signal of the appropriate voltage and frequency for powering high impedance gas discharge lamps. By varying the switching frequency of the switches Q1, Q2 in the inverter circuit 12, the resultant AC signal powers the gas-discharge lamps at either a normal power level or at a dimming power level. A DC blocking capacitor can be placed between the inverter output terminal 26 and the ballast circuits 14, 16 to block any DC components.

Each of these ballast circuits 14, 16 has a third-order resonant circuit 15, 17. The resonant circuits 15, 17 are designed in such a way that the current flow through the lamp impedances R_lamp__1, R_lamp__2 is nearly constant. Each resonant circuit 15, 17 may have a resonant inductor, L_resonant__1 and L_resonant__2, a resonant capacitor, C_resonant__1 and C_resonant__2, and a ballast capacitor, C_ballast__1 and C_ballast__2. The ballast capacitors, C_ballast__1 and C_ballast__2, are connected in series with the resonant inductor, L_resonant__1 and L_resonant__2 and the resonant capacitor, C_resonant__1 and C_resonant__2 to limit current to the lamps 22, 24. The resonant circuits 15, 17 in the ballast circuits 14, 16 are coupled to lamp output terminals 18, 20 which output the resultant AC signal to the lamps 22, 24.

Preferably, the ballast circuits 14, 16 are connected effectively in parallel to one another. As will be explained below, the reactance of the resonant circuits 15, 17 particularly the resonant inductors, L_resonant__1 and L_resonant__2, dominate the transfer functions of each ballast circuit 14, 16. In the illustrated embodiment, this means that each ballast circuit 14, 16 will see essentially the same voltage from the ballast input terminal 21 to the lamp output terminals 18, 22. The lamp impedances, R_lamp__1 and R_lamp__2 may be different, and there may be some components (Rf__3 and Rf__4 as examples) between the lamps 22, 24 causing a slight difference in the voltage seen by each ballast circuit. However, the dominance of the impedance of the resonant circuits 15, 17 causes the ballast circuits 14, 16 to see essentially the same voltage. Furthermore, so long as the resonant circuits 15, 17 in both ballast circuits 14, 16 have essentially the same component values both circuits will deliver essentially the same current to the lamps, even if the lamp impedances R_lamp__1 and R_lamp__2 are different.

As an example, the frequency domain transfer function of the first resonant circuit 15 is illustrated below:

$$\text{I_lamp} = \left| \frac{v_{eq_rms}}{j \cdot w \cdot L_{_resonant_1} + \dfrac{1}{j \cdot w \cdot C_{_resonant_1} + \dfrac{1}{\dfrac{1}{j \cdot w \cdot C_{_ballast_1}} + R_{_lamp_1}}}} \right|$$

It is evident that the transfer function of the system can be represented as the ratio of two finite polynomials with real and imaginary components. Thus, the expression could also be expressed as a numerator polynomial divided by a denominator polynomial. As is known in the art, the poles of the transfer function are the values of the transfer function in which the transfer function approaches infinity. For the lumped-parameter linear system described above, this means that the denominator polynomial approaches zero. In this case, the denominator polynomial has three factors and thus the transfer function has three poles.

To obtain the desired characteristics for the circuit, the reactance contributed by the first inductor L_resonant has to be large enough so that its impedance will dominate the whole equation. This maintains the current constant through the lamp. To accomplish this, the reactance of the resonant capacitor, C_resonant__1, should be very small compared to the reactance contributed from the ballast capacitor, C_ballast__1. In fact, a capacitance of the first resonant capacitor, C_resonant__1, should be at least five times smaller than a capacitance of the first ballast capacitor, C_ballast__1. In this manner the reactance of the first resonant capacitor can be ignored and the equation can be approximated as:

$$\text{I_lamp} = \left| \frac{v_{eq_rms}}{\left( j \cdot w \cdot L_{_resonant_1} + \dfrac{1}{j \cdot w \cdot C_{_ballast_1}} \right) + R_{_lamp_1}} \right|$$

The capacitive value of the first resonant capacitor, C_ballast__1, has to be large enough so as not to significantly affect the reactance in the transfer function of the circuit. For the reactance of the resonant inductor, L_resonant__1 to dominate the transfer function, the reactance contributed by the first resonant inductor, L_resonant__1, has to be large compared to the reactance contributed by the ballast capacitor, C_ballast__1. Also, for changes in the impedance of the lamp not to affect the current to the lamp, the reactance from the ballast should dominate the transfer function of the system. Accordingly, the relationship should be:

$$\left( j \cdot w \cdot L_{_resonant_1} + \frac{1}{j \cdot w \cdot C_{_ballast_1}} \right) >> \text{R_lamp_1}$$

In the embodiment shown in the Drawing, the second ballast circuit 16 has the same topology and component values as the first ballast circuit 14. Under these conditions, the second ballast circuit has an identical transfer function. The appropriate values for the reactance of the components in the resonant circuits 13, 15 shown in the Drawing (or for any topology consistent with the features of the invention) will depend on the effect on the current output to the lamp 22, 24. Changes in the impedance of either lamp 22, 24 or the wattage of either lamp 22, 24 should not significantly effect the current output. In most instances, if both the first and second resonant circuits 13, 15 are mirrors of one another (have the same or similar topology and component values) changes in the current should not be greater than 10%.

An example of appropriate component values for each of the resonant circuits 13, 15 of the embodiment of the invention shown in the Drawing are listed below:

L_resonant=7.3 mH, C_ballast=2.2 nF, C_resonant–560 pF

R_lamp__1=35 watt T5 lamp, R_lamp__2=14 Watt T5 lamp

Full light current design point=158 mA

Dimming light current design point=58 mA

At a normal power level, this results in a current of 158 mA to the 35 watt lamp and a current of 165 mA to the 14 watt lamp. During dimming, the current is 56 mA to the 35 watt lamp and 58 mA to the 14 watt lamp.

To preheat the filaments in the gas discharge lamps, the ballast circuits 14, 16 may have one or more pre-heating components, T_preheat, C_preheat, T_preheat_A, T_preheat_B, and T_preheat_C. The pre-heating components, T_preheat and C_preheat, are connected between the inverter output terminal 26 and the first and second resonant circuits 14, 16. The pre-heating components, T_preheat_A and T_preheat_B, are connected between the resonant circuits 15, 17 and the lamp output terminal 18, 20. T_preheat_C is connected to the lamps 22, 24. Together these components form a pre-heating circuit which can pre-heat the filaments of the lamps 22, 24 during dimming. However, these preheating components, T_preheat, C_preheat, T_preheat_A, T_preheat_B, and T_preheat_C, are not necessary and may be removed for instant start operation.

The circuit may also have current limiting components Cf__1, Cf__2, and Cf__3 for limiting the current to the filaments of the lamps 22, 24. A preferred embodiment of the invention also has an end of life protection circuit, 30. In many instances, a ballast may have an end of life circuit (not shown) which is designed to protect the electronic ballast and the gas discharge lamp from being damaged when the lamp reaches an end of lamp life condition. Consequently, the inverter 12 has an end of life input terminal 28 for receiving an end of life signal from the ballast circuits 14, 16. The end of life circuit in the inverter 12 can be utilized to detect continuity of the lamp filaments, and may be operable to provide end of lamp life protection, overheating protection, automatic reignition capabilities, and multiple striking capabilities.

If the end of life signal were measured directly from the high impedance lamps 22, 24, switching the lamps 22, 24 from the normal power level to the dimming power operation would cause a dramatic rise in voltage across the lamps 22, 24. This would cause the end of life circuit to shut down the inverter 12. Consequently, the end of life protection circuit 30 is connected to the input terminals 32, 34 of the resonant capacitors, C_resonant_1, C_resonant_2. Sensing the end of life signal from the first and second resonant capacitors, C_resonant_1 and C_resonant_2 solves this difficult shutdown problem. Even though the lamp current is greater at the normal power level than at the dimming power level, the inverter switches, Q1, Q2 operate at a lower switching frequency. Operating at a high current and lower switching frequency causes the voltage drop across the ballast capacitors, C_ballast_1, C_ballast_2 to be very large. This causes the voltage across the resonant capacitors, C_resonant_1, C_resonant_2 to be greater when the circuit is operating at a normal power level than in the dimming power level case. Thus, even though the lamp voltage is lower at the normal power level, the total voltage across the resonant capacitors, C_resonant_1, C_resonant_2 is greater at the normal power level than at the dimming power level. By sensing the end of life signal from the resonant capacitors, the end of life circuit in the inverter 12 can operate properly.

The end of life protection circuit 30 also has a first end of life sensing circuit 36 for measuring a first end of life signal from the first third order resonant circuit 15 and a second end of life sensing circuit 38 for measuring a second end of life signal from the second third order resonant circuit 16. Diodes D10 and D11 add the two sense voltages which are then fed through an end of life output terminal 37 to a voltage divider 39. The output of the voltage divider 39 is transmitted to the end of life input terminal 28 on the inverter 12.

It should be understood that the invention and disclosed topology can be utilized with any number of high impedance lamps, not just two. For example, ballast circuits with topologies similar to ballast circuits 14, 16 could be connected to the inverter output terminal 26. So long as sufficient power is provided to the inverter 12, the circuit can power as many lamps as necessary.

Thus, although there have been described particular embodiments of the present invention of a new and useful Constant Current Source Mirror Tank Dimmable Ballast for High Impedance Lamp, it is not intended that such references be construed as limitations upon the scope of this invention except as set forth in the following claims.

What is claimed is:

1. A dimming electronic ballast for operating a plurality of two or more high impedance lamps comprising:

an inverter;

a first ballast circuit comprising a first lamp output terminal configured to couple a first lamp current from the ballast to a first one of a plurality of two or more high impedance lamps;

a second ballast circuit comprising a second lamp output terminal configured to couple a second lamp current from the ballast to a second one of a plurality of two or more high impedance lamps;

the first ballast circuit further comprising a first resonant tank circuit coupled between the inverter and the first lamp output terminal;

the second ballast circuit further comprising a second resonant tank circuit coupled between the inverter and the second lamp output terminal;

the first and second ballast circuits are electrically coupled in parallel;

the inverter further comprising circuitry to cause the ballast to selectably operate in a full power mode and in a dimming power mode;

each of the first and second resonant circuits comprises a resonant inductor, a resonant capacitor, and a ballast capacitor having respective component values; and wherein the respective component values for the resonant inductor, resonant capacitor, and ballast capacitor in each of the first and second resonant circuits are selected so that when the ballast is connected to a plurality of two or more high impedance lamps, the ballast is functional to provide substantially constant and equal first and second lamp currents when operating in the full power mode, and to provide substantially constant and equal first and second lamp currents when operating in the dimming power mode.

2. The electronic ballast of claim 1, wherein each of the first and second resonant tank circuits is a third order resonant circuit; and in each of the first and second resonant circuits, the component value of the resonant capacitor is smaller than the component value of the ballast capacitor.

3. The electronic ballast of claim 2, wherein in each of the first and second resonant circuits, the ballast capacitor has a reactance value that is substantially less than a reactance value of the resonant inductor.

4. The electronic ballast of claim 3, further comprising:

in each of the first and second resonant circuits, a combined reactance of the ballast capacitor and the resonant inductor is substantially greater than impedances of high impedance lamps to be operated by the ballast.

5. The electronic ballast of claim 1, the inverter further comprising an inverter output terminal and the ballast further comprising lamp preheating circuitry coupled between the inverter output terminal and the first and second lamp terminals.

6. The electronic ballast of claim 5, comprise:

a DC blocking capacitor having a first terminal coupled to the inverter output terminal and a second terminal;

the lamp preheating circuitry comprises a preheat tank circuit coupled between the second terminal of DC blocking capacitor and the first and second resonant circuits;

a first preheat winding coupled between the first resonant circuit -and the first lamp output terminal, a second preheat winding coupled between the second resonant circuit and the second lamp output terminal, and a third lamp preheat winding.

7. The electronic ballast of claim 1, further comprising an end of life protection circuit comprising an end of life input terminal on the inverter;

a first sensing circuit coupled between the resonant capacitor in the first resonant circuit and the end of life input terminal, the first sensing circuit configured to sense a first lamp end of life voltage in the first resonant circuit; and a second sensing circuit coupled between the resonant capacitor in the second resonant circuit and the end of life input terminal, the second sensing circuit configured to sense a second lamp end of life voltage in the second resonant circuit.

8. The electronic ballast of claim 7, the end of life protection circuit further comprising:

a first diode coupled between the first sensing circuit and the end of life input terminal; and a second diode connected between the second sensing circuit and the end of life input terminal.

9. A lighting system comprising a dimmable electronic ballast for powering a plurality of gas discharge lamps, the ballast comprising:

an inverter circuit functional to operate in a normal mode and in a lamp dimming mode;

three or more lamp terminals configured to provide lamp currents to three or more gas discharge lamps;

three or more resonant circuits coupled between the inverter and the corresponding three or more lamp terminals;

each of the three or more resonant circuits comprises a third order resonant circuit having a resonant capacitor, a resonant inductor, and a ballast capacitor;

each resonant capacitor, resonant inductor, and ballast capacitor have respective component values; and wherein the respective component values for each resonant inductor, resonant capacitor, and ballast capacitor in each of the three or more resonant circuits are selected so that when the ballast is connected to the three or more gas discharge lamps, the ballast is functional to provide substantially constant and equal lamp currents when operating in the normal mode, and to provide substantially constant and equal lamp currents when operating in the dimming mode.

10. The lighting system of claim 9 further comprising three or more gas discharge lamps coupled to the three or more lamp terminals.

11. The lighting system of claim 10 wherein at least two of the three or more gas discharge lamps have different lamp impedances.

12. The lighting system of claim 10 wherein at least two of the three or more gas discharge lamps have different lamp wattage ratings.

* * * * *